US006659562B2

(12) United States Patent
Uchiyama

(10) Patent No.: US 6,659,562 B2
(45) Date of Patent: Dec. 9, 2003

(54) MOTOR-DRIVEN PASSENGER SEAT AND METHOD FOR ADJUSTING THE SAME

(75) Inventor: Satomi Uchiyama, Ota-ku (JP)

(73) Assignee: Minebea Company, Limited, Nagano (JP)

( * ) Notice: Subject to any disclaimer, the term of this patent is extended or adjusted under 35 U.S.C. 154(b) by 0 days.

(21) Appl. No.: 10/076,482

(22) Filed: Feb. 19, 2002

(65) Prior Publication Data

US 2002/0113477 A1 Aug. 22, 2002

(30) Foreign Application Priority Data

Feb. 21, 2001 (JP) ..... 2001-044999

(51) Int. Cl.[7] ..... A47C 7/50

(52) U.S. Cl. ..... 297/423.3; 297/423.36; 297/217.3; 297/423.32

(58) Field of Search ..... 297/362.11, 423.3, 297/423.36, 217.3, 423.32

(56) References Cited

U.S. PATENT DOCUMENTS 2,563,629 A * 8/1951 Watter ..... 297/423.36
4,669,780 A * 6/1987 Sakakibara et al. ..... 297/257
4,819,987 A * 4/1989 Stringer ..... 297/423.35
4,944,116 A * 7/1990 Mewald ..... 49/27
5,352,020 A * 10/1994 Wade et al. ..... 297/423.26
5,918,942 A * 7/1999 Olsen ..... 297/423.32
6,237,994 B1 * 5/2001 Bentley et al. ..... 297/118
6,439,636 B1 * 8/2002 Kuo ..... 296/65.09
2002/0046494 A1 * 4/2002 Miller et al. ..... 49/26

* cited by examiner

*Primary Examiner*—Peter M. Cuomo
*Assistant Examiner*—Stephen D'Adamo
(74) *Attorney, Agent, or Firm*—Oliff & Berridge, PLC

(57) ABSTRACT

A leg rest and a seat back are rotatably mounted at the front and the back of a sea cushion of a motor-driven seat, respectively. A foot rest is mounted on the leg rest so that it can be extended and retreated. Motor-driven actuators each having a potentiometer are individually connected to them. The motor-driven actuators are controlled by a controller in response to an input of an operation switch, based on a position determined by the potentiometer, and in accordance with a predetermined reference position, thereby adjusting the angles and the positions of the seat parts. The motor-driven actuator is temporarily moved to the end of the stroke, so that limit switches are activated, and the reference position is adjusted based on the position determined by the potentiometer, thereby significantly reducing the amount of adjustment work.

10 Claims, 4 Drawing Sheets

MOTOR-DRIVEN PASSENGER SEAT AND METHOD FOR ADJUSTING THE SAME

BACKGROUND OF THE INVENTION

1. Field of the Invention

The present invention relates to a motor-driven passenger seat which is installed in a passenger cabin of vehicles, such as aircraft, ships and cars, and in which positions of the seat parts, such as a seat back, a leg rest and a foot rest, can be adjusted by motor-driven actuators, and to a method for adjusting the reference positions of the seat parts.

2. Description of the Related Art

Referring to FIG. 5, a motor-driven seat installed in a passenger cabin of an aircraft will be described as an example of the motor-driven passenger seat. In a motor-driven seat 1, a seat back 3 is rotatably mounted at a rear end of a seat cushion 2, and a leg rest 4 is rotatably mounted at a front end thereof, and a foot rest 5 is mounted on the leg rest 4 in such a manner that it can be extended and retracted, as shown in FIG. 5.

The seat back 3, the leg rest 4 and the foot rest 5 are adjusted by actuators (not shown) such as electric motors, and a passenger who seats in the motor-driven seat 1 operates for example a switch or (not shown) near at hand; thus, the angle of the seat back 3 can be freely adjusted between an upright position (refer to the solid lines in FIG. 5) at which the seat back 3 is almost perpendicular to the seat cushion 2 and an almost horizontal position (refer to the dash-double-dot lines A in FIG. 5), and the angle of the leg rest 4 can be freely adjusted between a housed position (refer to the dash-double-dot line B in FIG. 5) at which it is directed vertically downward and an almost horizontal position (refer to the dash-double-dot line C in FIG. 5). Also, the foot rest 5 can be freely positioned between a retracted position (refer to the dash-double-dot line B in FIG. 5), at which the foot rest 5 is housed in the leg rest 4, and an extended position (refer to the dash-double-dot line C in FIG. 5) at which it is fully extended.

Accordingly, the seat back 3 and the leg rest 4 can be moved to the horizontal position and the foot rest 5 can be extended to the extended position; thus, the motor-driven seat 1 can be used as a bed (refer to the dash-double-dot lines A and C in FIG. 5).

In a conventional motor-driven seat 1, each actuator is provided with a limit switch to control the operation of the actuators by detecting the movement of the seat to a predetermined position limiting the range of movement of the moveable parts such as the seat back 3, the leg rest 4, and the foot rest 5 to avoid interference with other objects such as the floor 6 and to automatically obtain specific positions (such as seat position or bed position) by synchronous movement of individual seat parts.

However, the conventional motor-driven seat 1 has the following problems. In order to adjust the operating positions of the limit switches of the seat parts, it is necessary to move the actuators to proper positions and to adjust the positions at which the limit switches are mounted so as to determine the seat positions. In this instance, whether the adjusted positions are right or not is visually checked by activating the actuators again and operating the limit switches. When the adjusted positions are not right, they must be adjusted again. Since this process must be performed for each of the limit switches of the actuators, adjustment is extremely complicated.

SUMMARY OF THE INVENTION

The present invention has been made in the light of the above problems. Accordingly, it is an object of the present invention to provide a motor-driven passenger seat in which the range of movement and operating positions of the actuators can be easily adjusted, and a method for adjusting the same.

In order to achieve the above object, according to the present invention, a motor-driven passenger seat comprises: a plurality of motor-driven actuators for adjusting positions of seat parts; a position determining device for determining an operating position of the motor-driven actuator; a sensor for detecting the movement of the motor-driven actuator to an end of a stroke; and a controller for controlling operation of the motor-driven actuator in response to an input of an operation switch, based on a position determined by the position determining device, and in accordance with a predetermined reference position, wherein the controller moves the motor-driven actuator to the end of the stroke, and the sensor has an adjusting mode for adjusting the reference position based on the position determined by the position determining device when the sensor senses the end of the stroke.

In such an arrangement, a range of movement of the motor-driven actuator and a point to which the parts are synchronously moved can be changed by changing the setting of the reference position. Also, the adjusting mode is carried out and the motor-driven actuator is temporarily moved to the end of the stroke, so that the reference position to which the motor-driven actuator is controlled can be adjusted based on the position of the end of the stroke.

According to the present invention, there is provided a method for adjusting a motor-driven passenger seat comprising a plurality of motor-driven actuators for adjusting the positions of seat parts; a position determining device for determining the operating positions of the motor-driven actuators; a sensor for sensing the movement of each of the motor-driven actuators to the end of the stroke; and a controller for controlling the operation of the motor-driven actuators in response to an input of the operation switch, based on the position determined by the position determining device and in accordance with the reference positions, comprising the steps of: moving each of the motor-driven actuators to the end of the stroke; and adjusting the reference position based on the position determined by the position determining device when the sensor senses the end of the stroke.

In such an arrangement, each of the motor-driven actuators is temporarily moved to the end of the stroke, so that the reference position for controlling the motor-driven actuator can be adjusted based on the position of the end of the stroke.

DESCRIPTION OF THE PREFERRED EMBODIMENTS

An embodiment of the present invention will be specifically described hereinbelow with reference to the drawings.

Figure 1:
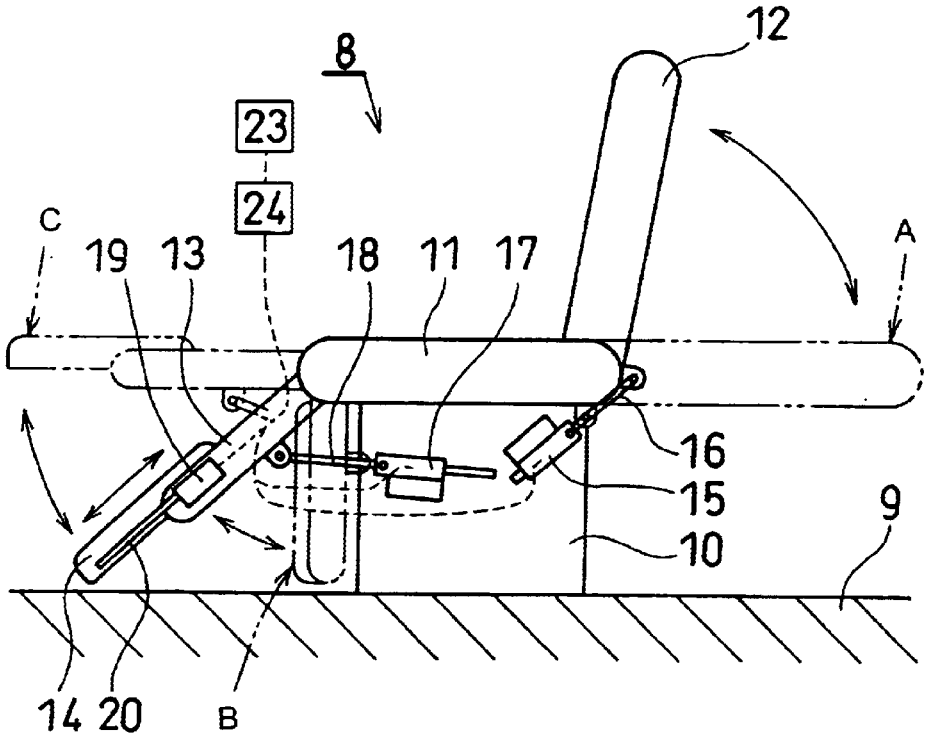
FIG. 1 is a side view showing a schematic structure of a motor-driven seat according to an embodiment of the present invention.

As shown in FIG. 1, a motor-driven passenger seat 8 according to the embodiment is a reclining seat which is placed in a passenger cabin of an aircraft, wherein a base 10 fixed on a floor 9 of a body of the aircraft has a seat cushion 11, a seat back 12 disposed at a rear end of the seat cushion 11, and a leg rest 13 disposed at a front end thereof, wherein the seat back 12 and the leg rest 13 are rotatably supported with respect to the seat cushion 11. In addition, the leg rest 13 has a foot rest 14 mounted thereon in such a manner that it can be extended and retracted.

An operating rod 16 of a seat back actuator 15 which is mounted on the base 10 is connected to the seat back 12. By extending the operating rod 16, the seat back 12 can be rotated between an upright position (refer to the solid line in FIG. 1) at which it is inclined slightly backward from an upright position and an almost horizontal position (refer to the dash-double-dot line A in FIG. 1).

An operating rod 18 of a leg rest actuator 17 which is mounted on the base 10 is connected to the leg rest 13. By extending the operating rod 18, the leg rest 13 can be rotated between a housed position (refer to the dash-double-dot line B in FIG. 1) at which it is directed vertically downward and an almost horizontal position (refer to the dash-double-dot line C in FIG. 1).

An operating rod 20 of a foot rest actuator 19 which is mounted on the leg rest 13 is connected to the foot rest 14, wherein, by extending the operating rod 20, the foot rest 14 can be extended and retracted between a retracted position (refer to the dash-double-dot line B in FIG. 1), at which the foot rest 14 is housed in the leg rest 13, and an extended position (refer to the dashdouble-dot line C in FIG. 1), at which the foot rest 14 is fully extended.

A motor-driven actuator 21 used as the seat back actuator 15, the leg rest actuator 17 or the foot rest actuator 19 will be described with reference to FIGS. 3 and 4.

Figure 3:
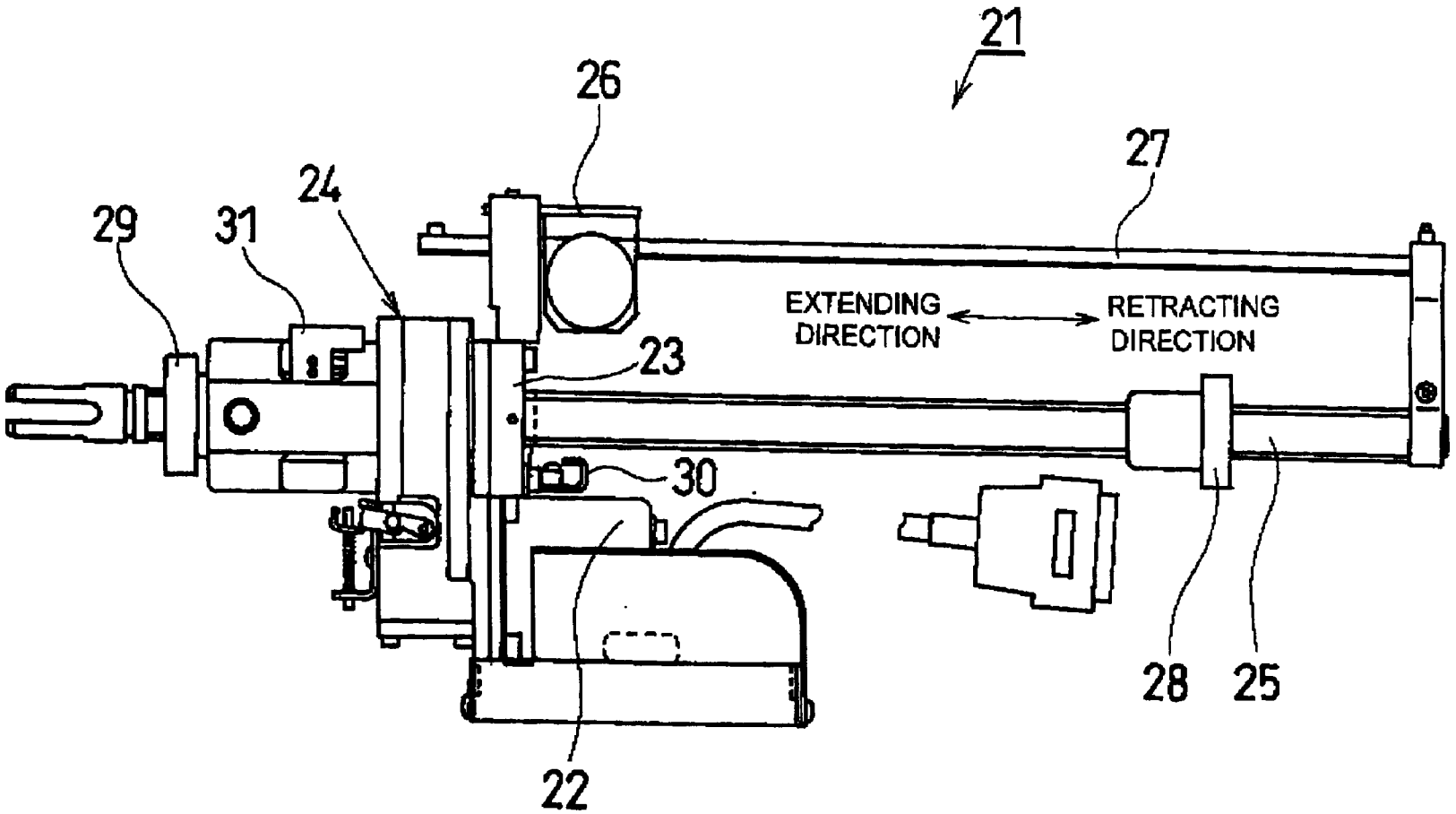
FIG. 3 is a plan view of a motor-driven actuator of the motor-driven seat shown.
Figure 4:
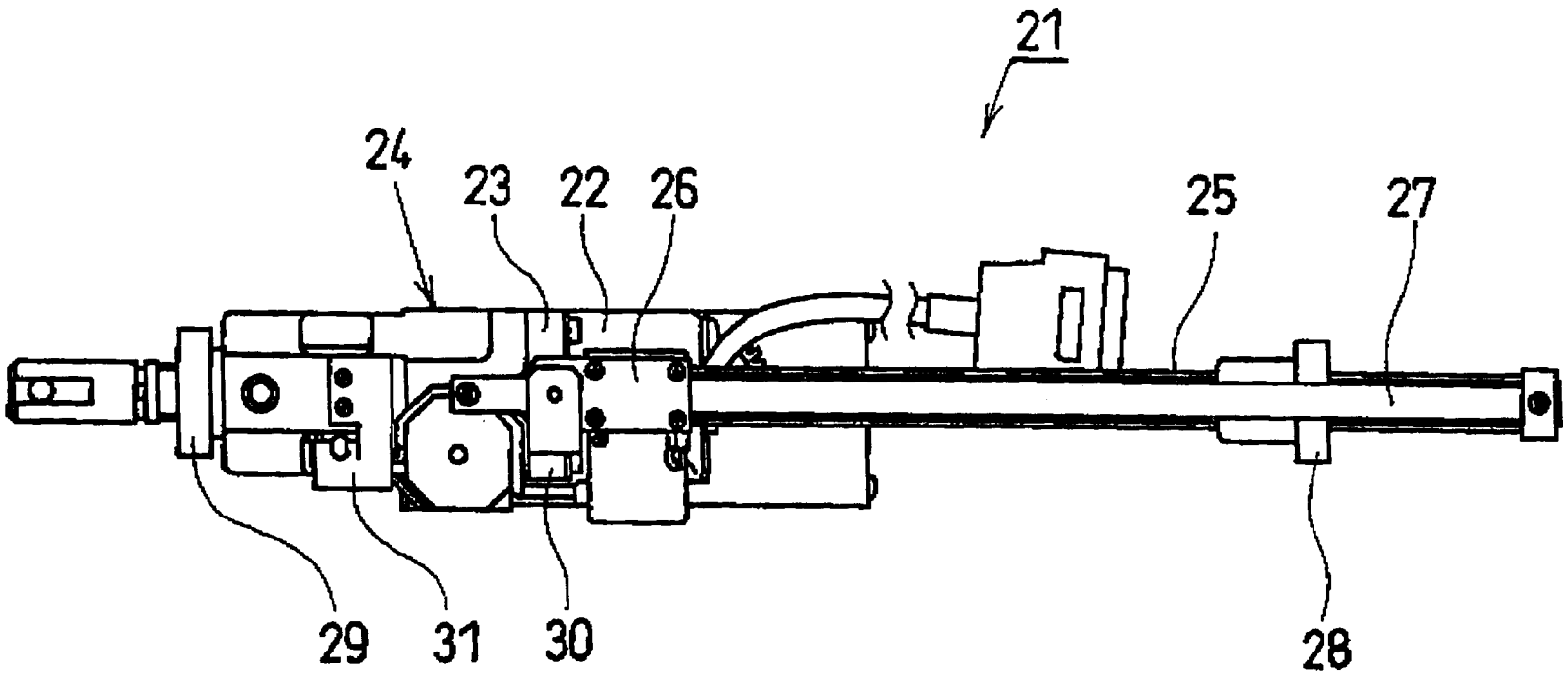
FIG. 4 is a side view of the motor-driven actuator shown in FIG. 3.
Figure 5:
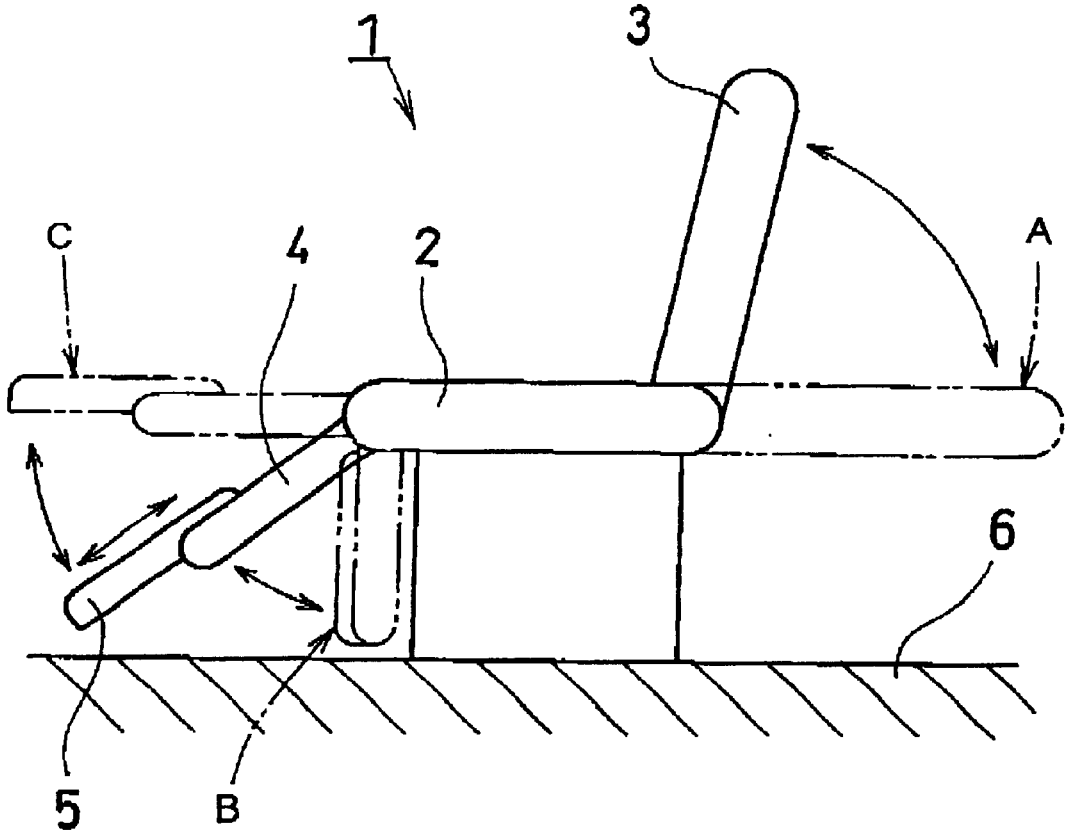
Fig. 5 Prior Art
FIG. 5 is a side view showing a schematic structure of a conventional motor-driven seat for aircraft.

In the motor-driven actuator 21, an operating rod 25 is inserted in an actuator main body 24 having a motor 22 and a feed mechanism 23, as shown in FIGS. 3 and 4, wherein the rotation of the motor 22 is converted to a rectilinear motion by the feed mechanism 23 to extend or retract the operating rod 25. A potentiometer (position determining device) 26 is mounted on the actuator main body 24, is rotated in accordance with the movement of a rack 27 connected to the operating rod 25, and determines the position of the operating rod 25.

Stoppers 28 and 29 are mounted in the vicinity of both ends of the operating rod 25, wherein one stopper 28 comes into contact with the actuator main body 24 and controls a physical maximum extended position of the operating rod 25, and the other stopper 29 comes into contact with the actuator main body 24 and controls a physical minimum retracted position of the operating rod 25, thereby determining a physical range of movement (here, called a physical limit) of the operating rod 25.

The actuator main body 24 is provided with limit switches (sensors) 30 and 31 which are opposite to the stoppers 28 and 29 mounted on the operating rod 25, respectively. The stoppers 28 and 29 come into contact with the limit switches 30 and 31, respectively, before coming into contact with the actuator main body 24, thereby suspending the motor 22. Accordingly, a mechanical range of movement (here, called a mechanical limit) of the operating rod 25 is controlled, thereby preventing an over travel of the operating rod 25.

The motor-driven actuators 21, which are mounted on the motor-driven seat 8 as the seat back actuator 15, the leg rest actuator 17 and the foot rest actuator 19, are connected to a controller (not shown) based on a microprocessor. A passenger who seats in the motor-driven seat 8 can control the operation of the motor 22 via the controller by operating an operation switch (not shown) disposed near the hand, and can move or suspend the operating rod 25, thereby fixing it at an arbitrary position.

The controller controls the operation of the motor 22 based on a position signal from the potentiometer 26 of each of the motor-driven actuators 21 in response to an input of the operation switch. The maximum extended position and the minimum retracted position (here, called a soft limit) for determining a substantial range of movement of the operating rod 25 are written in advance in a rewritable external memory (such as EEPROM) of a CPU in the controller. When the operating rod 25 is extended or retracted to the soft limit (reference position), the controller stops the motor 22 to suspend the extension or the retraction of the operating rod 25.

A plurality of reference positions is written in advance within the soft limits between the extended position and the retracted position in the external memory. Therefore, when the operating rod 25 reaches a reference position, the motor 22 can be suspended, or predetermined operations of the motor 22 of the other motor-driven actuator 21 can be started. Thus, for example, the parts of the motor-driven seat 8 can be automatically moved to specified angles or positions, and can also be returned to initial positions in response to an input of the operation switch.

Figure 2:
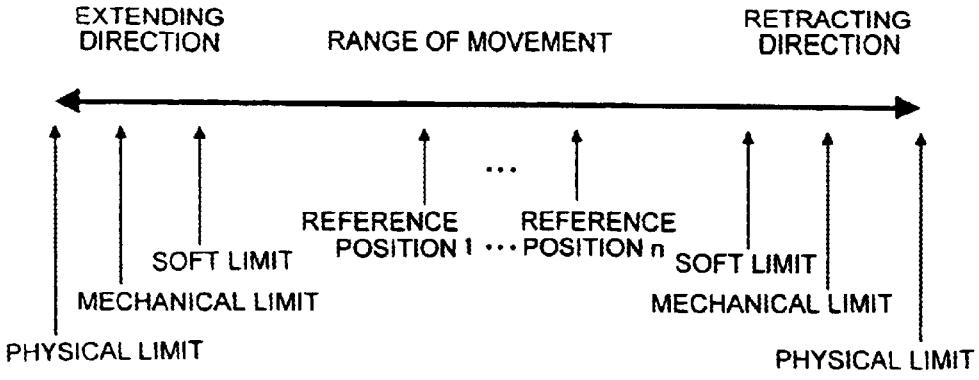
FIG. 2 is an explanatory view showing the reference positions of motor-driven actuators of the motor-driven seat shown in FIG. 1.

The range of movement of the motor-driven actuator 21 can be changed and the point to which the plurality of motor-driven actuators 21 are synchronously operated can also be changed by rewriting the soft limit and the reference positions which are stored in the external memory. The positional relationship among the physical limit of the stoppers 28 and 29, the mechanical limit of the limit switches 30 and 31, and the soft limit and the reference positions of the controller are shown in FIG. 2.

The controller has an adjusting mode for adjusting the soft limit and the reference positions. In the adjusting mode, the operating rod 25 of each of the motor-driven actuators 21 mounted on the motor-driven seat 8 is automatically extended or retracted, the limit switches 30 and 31 are activated, and the range of movement of the operating rod 25 is recognized by reading a position determined by the potentiometer 26 at this position, thus the soft limit and the reference positions are automatically adjusted based on the range of movement, according to predetermined rules (for example, the soft limit is set a specified distance before the mechanical limit).

In this instance, the order of movement of the motor-driven actuators 21, which are individually mounted on the parts, to the mechanical limit is set in advance so that the seat back 12, the leg rest 13 and the foot rest 14 do not contact with the other parts while traveling.

The operation of the present embodiment as constructed above will be described hereinbelow.

The passenger who seats in the motor-driven seat 8 controls the seat back actuator 15, the leg rest actuator 17 and the foot rest actuator 19 with the operation switch near at hand; therefore, he can freely adjust the angular position of the seat back 12 and the leg rest 13 and the extended position of the foot rest 14. Furthermore, by moving the seat back 12 and the leg rest 13 to the horizontal position and extending the foot rest 14 to the extended position, the passenger can use the motor-driven seat 8 as a bed (refer to the dash-double-dot lines A and C in FIG. 1).

In this instance, each of the motor-driven actuators 21 is controlled in response to an input of the operation switch and based on the position determined by the potentiometer 26, and in accordance with the soft limit and the reference positions written in the external memory. Thus, the operating range of the operating rod 25 and the point to which the parts are synchronously moved can be easily changed by rewriting the soft limit and the reference positions in the external memory.

The soft limit and the reference positions of the motor-driven seat 8, in which the motor-driven actuators 21 are assembled, can be adjusted by activating the adjusting mode of the controller. When the adjusting mode is activated, the operating rod 25 of each of the motor-driven actuators 21 is automatically moved to the mechanical limit, the limit switches 30 and 31 are activated, and the soft limit and the reference positions are adjusted based on the position determined by the potentiometer 26.

Accordingly, as long as the relative positions between the stoppers 28 and 29 and the limit switches 30 and 31 of each of the motor-driven actuators 21, which determine the mechanical limit, are accurately set in advance using for example a jig, by merely activating the adjusting mode after the motor-driven actuators 21 have been assembled in the motor-driven seat 8, the soft limit and the reference positions can be automatically adjusted, thereby significantly decreasing the adjusting operation.

In the above-described embodiment, a motor-driven seat in which the angles and the positions of the seat back, the leg rest and the foot rest can be adjusted by the motor-driven actuator is described as an example. However, the present invention is not limited to this, and can be similarly applied to a motor-driven seat in which the other parts can be adjusted by the motor-driven actuators. Also, in the above-described embodiment, while a case in which the present invention is applied to passenger seats of aircraft is explained, the present invention is not limited to this, and can be similarly applied to passenger seats for other vehicles, such as cars, and ships.

As specifically described above, in the motor-driven passenger seat according to the present invention, the range of movement of the motor-driven actuator and the point to which the parts are synchronously moved can be easily changed by changing the setting of the reference positions of the controller. In addition, the adjusting mode is activated and the motor-driven actuator is temporarily moved to the end of the stroke, so that the reference positions to control the operation of the motor-driven actuators can be automatically adjusted based on the position of the end of the stroke. As a result, the amount of adjustment work of the reference positions of the moving parts of the motor-driven seat can be significantly reduced.

Further, according to the method for adjusting the motor-driven passenger seat of the present invention, the motor-driven actuator is temporarily moved to the end of the stroke, so that the reference positions to control the operation of the motor-driven actuators can be adjusted based on the position of the end of the stroke, and the amount of adjustment work of the reference positions of the moving parts of the motor-driven seat can be significantly reduced.

What is claimed is:

1. A motor-driven passenger seat comprising:

a plurality of motor-driven actuators for adjusting positions of seat parts;

position determining means for determining operating positions of the motor-driven actuators;

sensing means for detecting movement of the motor-driven actuators to an end of a stroke; and a controller for controlling operation of the motor-driven actuators in response to an input of an operation switch, based on the operating positions determined by the position determining means, and in accordance with predetermined reference positions, wherein the controller moves the actuators to the end of the stroke; and the sensing means has an adjusting mode for automatically adjusting the reference positions based on the operating positions determined by the position determining means when the sensing means detects the end of the stroke.

2. The motor-driven passenger sear according to claim 1, wherein the position determining means is a potentiometer and the sensing means is a limit switch.

3. A method for readjusting the range of motion for a motor-driven passenger seat the method comprising the steps of:

engaging motor-driven actuators of the passenger seat to the end of a stroke;

determining operating positions of the motor-driven actuators;

detecting the end of the stroke; and automatically adjusting Preference positions based on the operating positions determined when the end of stroke is detected.

4. The method according to claim 3, wherein the step of determining operating positions is performed using a potentiometer and the step of detecting the end of stroke is performed using a limit switch.

5. A control mechanism for actuating a power seat, comprising:

a plurality of actuators allowing a range of motions of the power seat, the range of motions having at least a mechanical limit range of motion and a soft limit range of motion, the soft limit having a predetermined range of motion within the mechanical limit range;

a position device for determining operating positions of the actuators;

a sensor for detecting an end of a stroke of the mechanical limit; and a controller for controlling the operating position of the actuators, the controller having an adjusting mode for automatically adjusting the range of motion of the soft limit based on the operating positions determined when the end of stroke is detected.

6. A control mechanism according to claim 5, wherein the plurality of actuators have a physical limit range of motion.

7. A control mechanism according to claim 5, wherein the soft limit has a maximum extended position and a minimum retracted position.

8. A control mechanism according to claim 7, further comprising:

a plurality of reference positions within the soft limit so that each actuator, upon reaching one of the plurality of reference positions, can undergo a predetermined operation.

9. A control mechanism according to claim 5, wherein the end of stroke is defined by the maximum and minimum range of the mechanical limit.

10. A control mechanism according to claim 9, wherein while in the adjusting mode the sensor detects the end of stroke and the position device determines the operation position prior to resetting the soft limit and the reference positions.

* * * * *